United States Patent [19]

Grundy

[11] Patent Number: 4,560,151

[45] Date of Patent: Dec. 24, 1985

[54] TRANSMISSION MOUNTING STAND

[76] Inventor: Leslie R. Grundy, 1190 Theresa Ave., Campbell, Calif. 95008

[21] Appl. No.: 615,145

[22] Filed: May 30, 1984

[51] Int. Cl.[4] ..... B66F 5/04

[52] U.S. Cl. ..... 269/17; 269/50; 269/296; 254/DIG. 16

[58] Field of Search ..... 254/133, 134, DIG. 16; 269/17, 296, 50, 51

[56] References Cited

U.S. PATENT DOCUMENTS

| | | | |
|---|---|---|---|
| 3,062,500 | 11/1962 | Arnes et al. | 254/134 |
| 3,095,182 | 6/1963 | Platt | 254/134 |
| 3,136,526 | 6/1964 | Wolf | 254/134 |
| 3,559,981 | 2/1971 | Abshear | 254/134 |
| 3,958,793 | 5/1976 | Garate | 254/133 R |
| 4,123,038 | 10/1978 | Meyers | 254/134 |
| 4,269,394 | 5/1981 | Gray | 254/134 |
| 4,307,877 | 12/1981 | Rogos | 269/17 |
| 4,383,681 | 5/1983 | Walters | 269/17 |
| 4,445,667 | 5/1984 | Webb | 254/134 |

*Primary Examiner*—Robert C. Watson

*Attorney, Agent, or Firm*—Fliesler, Dubb, Meyer & Lovejoy

[57] ABSTRACT

A stand (10) selectively positions a transmission case (12) having a wider end portion (14) and a narrower end portion (16). A generally rigid and open frame (18) supports a yoke (48) adjacent its front end. The yoke (48) extends across the frame (18) and has a pair of side bar structures (56,58) to which the wider end portion (14) of the transmission case (12) is attachable. A support structure (86) includes an upwardly extending support crossbar (88) having a support platform (100) and is adapted to support the narrower end portion (16) of the yoke (48). The support structure (86) may be mounted in several different orientations thereby allowing the transmission case (12) to be mounted in several different orientations.

6 Claims, 4 Drawing Figures

TRANSMISSION MOUNTING STAND

DESCRIPTION

1. Technical Field

This invention relates to a stand for selectively positioning a transmission case in various orientations so that mechanical work can be performed upon the case and upon a transmission held within the case.

2. Background Art

Transmission cases generally have a wider end and a narrower end and contain and support a transmission in an interior longitudinally extending cavity. The transmission is accessible for service via the wider end which is open during servicing. A transmission case, particularly one with a transmission in it, is quite heavy. When one is servicing a transmission mounted within a transmission case it is sometimes desirable to have the transmission case generally horizontal, at other times it is desirable to have the wider end of the transmission case facing upwardly with the transmission case generally vertical, and at still other times it is desirable to have the transmission case cantered at an angle from the horizontal and from the vertical with the wider end facing somewhat upwardly. Furthermore, it is sometimes desirable to move the transmission case from one place to another. Since the case is quite heavy with the transmission in it this can be a difficult task to perform.

A number of support stands of one sort or another are known for use in supporting various parts of automobiles and automobile engines. Such devices are taught for example in U.S. Pat. No. 4,268,020, issued May 19, 1981 to A. E. Wood; U.S. Pat. No. 2,985,448, issued May 23, 1961 to H. E. Hancock; U.S. Pat. No. 3,381,953, issued May 7, 1968 to W. R. Miller; U.S. Pat. No. 4,116,424, issued Sept. 26, 1978 to T. Varga, A. Devine, Jr. and W. Meikle; U.S. Pat. No. 4,140,306, issued Feb. 20, 1979 to J. H. Wheeler; U.S. Pat. No. 4,202,539, issued May 13, 1980 to R. S. Polastri and H. Ruzicka, Jr.; U.S. Pat. No. 4,239,196, issued Dec. 16, 1980 to J. E. Hanger; U.S. Pat. No. 4,010,942, issued Mar. 8, 1977 to G. L. Ward; U.S. Pat. No. 1,495,894, iIssued May 27, 1924 to H. J. Du Bois; U.S. Pat. No. 1,611,738, issued Dec. 21, 1926 to W. C. J. Guilford; U.S. Pat. No. 2,879,059, issued Mar. 24, 1959 to D. M. Sandefur; and U.S Pat. No. 2,703,252, issued Mar. 1, 1955 to R. G. Blackwell. U.S. Pat. No. 3,355,162, issued Nov. 28, 1967 to R. M. Kerr sets forth a repair stand for working with an output motor for a boat.

While all of apparatus taught in the above mentioned patents finds use in one way or another, such apparatus is not readily adaptable or highly advantageous for use in supporting an object of the nature of a transmission case.

DISCLOSURE OF THE INVENTION

This invention is concerned in solving one or more of the problems as set forth above.

In accordance with an aspect of the present invention a stand is set forth for selectively positioning a case which has a wider end portion having generally a width, D, and a narrow end portion having a width, d. The stand includes a rigid frame having a bottom portion adapted to sit on a floor, a top portion, a front portion, a rear portion and left and right side portions. The stand also includes a yoke having a yoke crossbar having opposite ends and a pair of side bars each extending generally in a first direction from a respective one of the opposite ends to respective end portions a distance, L, which is greater than or substantially equal to D/2, from the yoke crossbar. Means are provided for supporting the yoke crossbar from the left side portion to the right side portion adjacent the front portion and a distance, H, above the floor. Means are provided for releasably attaching the wider end portion of the case between the remote end portions of the side bars of the yoke. The stand includes a support structure having a support crossbar having opposite end portions and a support bar having a first end attached to the support crossbar intermediate the opposite end portions and a second end having a support platform a distance, 1, from the support crossbar, the support platform being adapted to support the narrow end of the case. First support means are provided for supporting the support crossbar from the left side portion to the right side portion with the support platform generally vertically above the support crossbar intermediate the front portion and the rear portion and a distance, h, above the floor. The stand is designed so that the case can be supported generally horizontally by the yoke and the support structure.

A transmission stand as set forth above allows a transmission case to be positioned in a desired orientation whereby a mechanic can easily work on it. The stand may include wheels so that it can be moved from place to place while the transmission stand is supported by it. Additional structures can be added to the stand to allow the transmission to be mounted in a number of different orientations relative to the horizontal and vertical. The entire stand is relatively rugged and relatively inexpensive to fabricate.

BRIEF DESCRIPTION OF THE DRAWINGS

The invention will be better understood by reference to the figures of the drawings wherein like numbers denote like throughout and wherein.

BEST MODE FOR CARRYING OUT THE INVENTION

Figure 1:
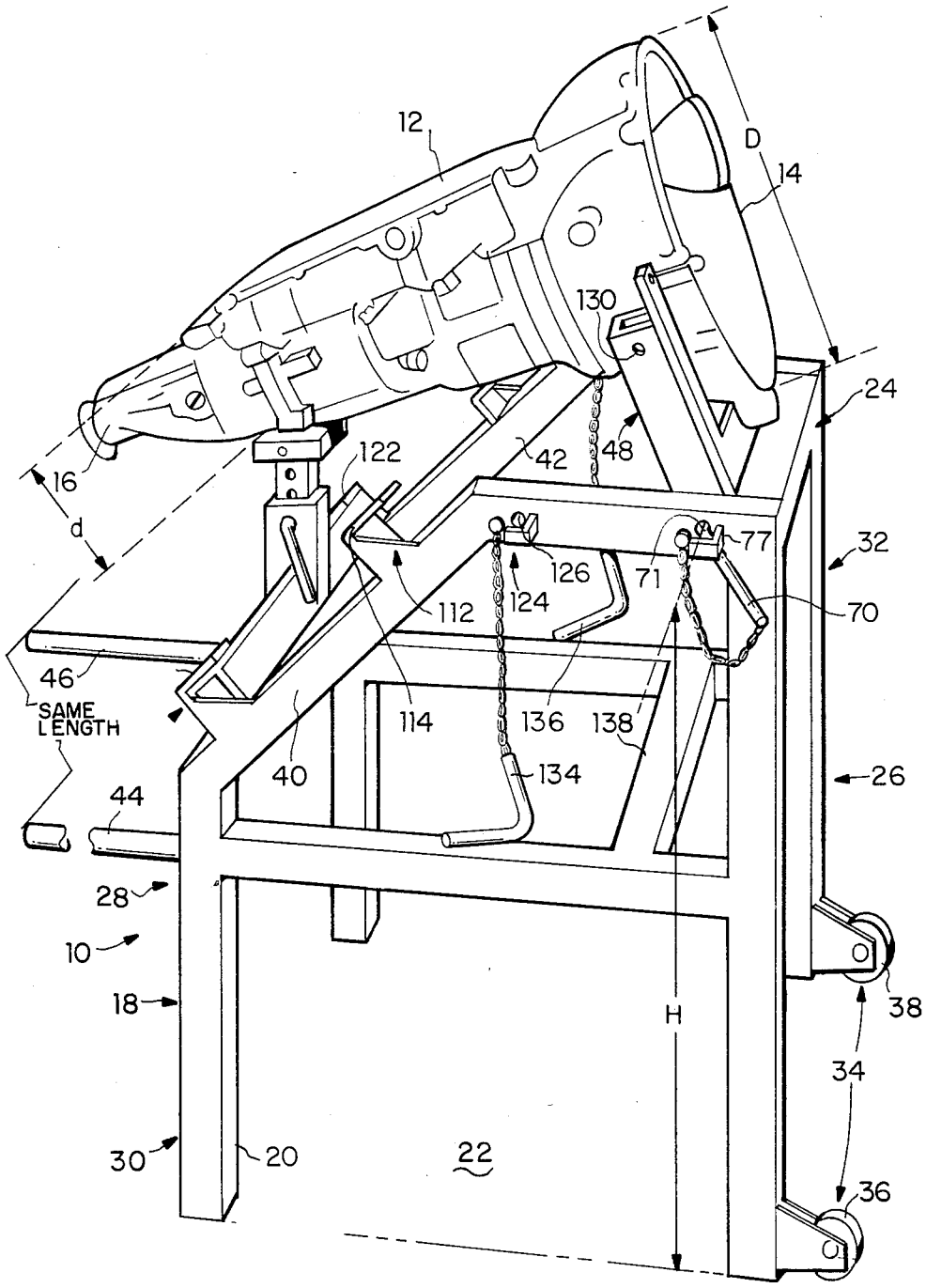
FIG. 1 illustrates a stand in accordance with the present invention supporting a transmission case at an angle from the horizontal and the vertical in a perspective view taken from the left and slightly to the front and above the stand.

FIG. 1 shows a stand 10 in accordance with the present invention. A transmission case 12 is shown supported by the stand 10. The transmission case 12 has an open wider end portion 14 which has generally a width, D, and a narrow end portion 16 which has generally a width, d.

A rigid frame 18 is provided which has a bottom portion 20 adapted to sit on a floor 22. The frame 18 also has a top portion 24, a front portion 26, a rear portion 28, a left side portion 30 and a right side portion 32. The bottom portion 20, in the embodiment illustrated, includes appropriate rolling means 34, such as wheels 36 and 38. The front portion 26 preferably extends to a higher elevation than does the rear portion 28.

The left side portion 30 and the right side portion 32 of the frame 18 generally include a pair of parallel rails 40,42 which extend generally upwardly from the rear portion 28 towards the front portion 26. This is useful, as will be pointed out in the following, for allowing the transmission case 12 to be positioned at any of several angles from the horizontal and vertical.

Handles 44 and 46 may extend from the rear portion 28 of the frame 18 so that the frame 18 can be lifted upwardly at its rear portion 28 whereby the wheels 36 and 38 support the entire weight of the stand 10. This is done in order to move the stand 10 from one position to another. Generally the handles 44,46 will be removable from appropriate openings in the frame 18 so that they will be out of the way when a mechanic is working on a transmission (not shown) mounted in the transmission case 12.

Figure 2:
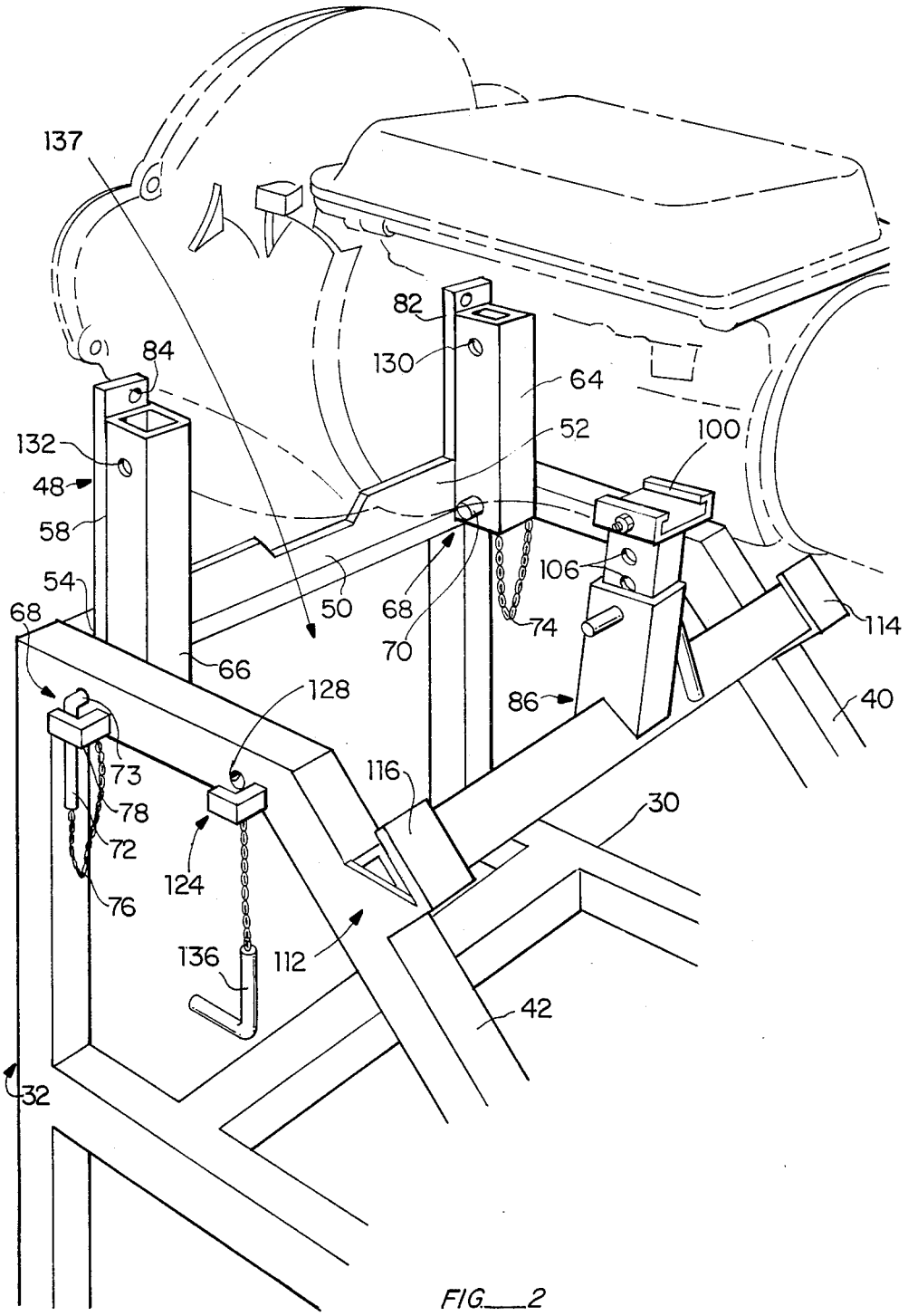
FIG. 2, illustrates, in partial perspcetive view, a transmission stand in accordance with the present invention taken from above the top right rear of the stand and showing a transmission case, in phantom, held in a generally horizontal position by the transmission stand.
Figure 3:
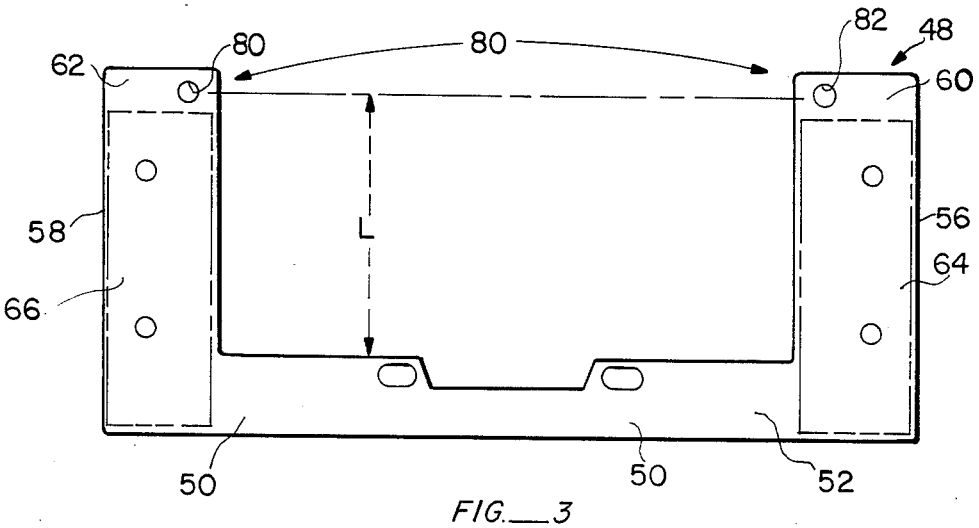
FIG. 3 illustrates a yoke portion of the transmission stand.

A yoke 48, seen in FIGS. 1, 2 and 3, forms an important part of the stand 10. In particular, the yoke 48 serves for supporting the wider end portion 14 of the transmission case 12. The yoke 48 has a yoke crossbar 50 having opposite ends 52,54 (see particularly FIGS. 2 and 3) and a pair of side bars 56,58, each extending generally in a first direction from a respective one of the opposite ends 52,54 to respective end portions 60,62 a distance, L which is greater than or substantially equal to D/2 from the yoke crossbar 50. The side bars 56,58, in the embodiment illustrated, include respective tubular members (see FIG. 2) 64,66 for rigidity.

Means 68, in the embodiment illustrated a pair of L-shaped rods 70,72, serves for mounting the side bars 56,58 adjacent the opposite ends 52,54 of the yoke crossbar 50 to the top portion 24 of the frame 18. In the embodiment illustrated the L-shaped rods 70,72 pass through respective holes 71,73 in the top portion 24 of the frame 18 and corresponding holes in the tubular members 64,66. For convenience, the L-shaped rods 70,72 may be fastened to the top portion 24 of the frame 18 by small chains 74,76. Stops, such as the stops 77 and 78 seen in FIGS. 1 and 2, may be provided to assure that the L-shaped rods 70,72 do not slip out of the holes in the frame 18 and yoke 48. The means 68 thus serves as means for supporting the yoke crossbar 50 from the left side portion 30 to the right side portion 32 of the frame 18. The yoke supporting means 68 is located adjacent the front portion 26 of the frame 18 at a distance, H, above the floor 22. The distance, H, is generally selected so that the wider end portion 14 of the transmission case 12 is at a convenient height for a mechanic to work upon a transmission held within the transmission case 12.

Means 80 are provided for releasably attaching the wider end portion 14 of the transmission case 12 between the remote end portions 60,62 of the side bars 56,58 of the yoke 48. In the particular embodiment illustrated, the releasable attaching means 80 comprises appropriately spaced and positioned holes 82 and 84 through the remote end portions 60,62 of the side bars 56,58 for mating with holes already present in the wider end portion 14 of the transmission case 12. Since one transmission case 12 may vary in size from another, it is contemplated that different yokes 48 will be used with different transmission cases 12 so as to assure proper matching of the holes 82 and 84 with each particular transmission case 12.

Figure 4:
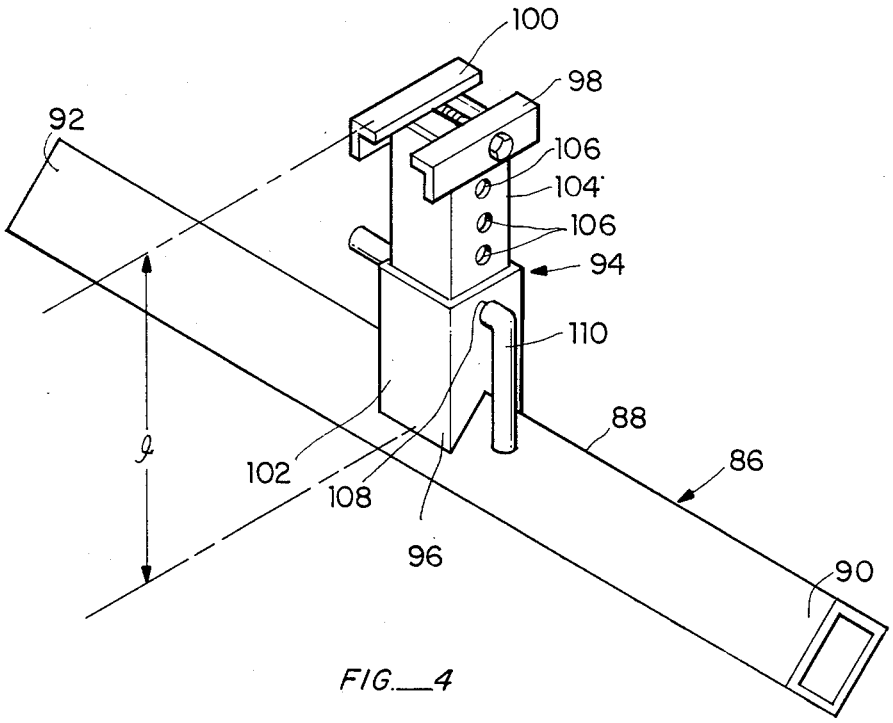
FIG. 4 illustrates a support structure portion of a transmission stand.

A support structure 86, seen most clearly in FIG. 4, forms a part of the stand 10. The support structure 86 has a support cross bar 88 having opposite end portions 90,92 and a support bar structure 94 having a first end 96 attached to the support cross bar 88 intermediate the opposite end portions 90,92 and a second end 98 supporting a support platform 100 a distance, l, from the support cross bar 88. The support platform 100 is adapted to support the narrower end portion 16 of the transmission case 12. In the embodiment illustrated, the support bar structure 94 includes a first portion 102 directly attached to the support cross bar 88 and a second portion 104 which telescopes with the first portion 102. The amount of telescoping is controlled by a plurality of pairs of longitudinally spaced holes 106 through the second portion 104. Each of the longitudinally spaced holes 106 is alignable with a pair of holes 108 through the first portion 102. An L-shaped rod 110 serves for passing through the holes 108 and any appropriate one of the pairs of holes 106 to fasten the platform 100 at a desired height. This allows the tilt of the transmission case 12 to be adjusted, as desired.

The stand 10 includes first support means 112 for supporting the support cross bar 88 from the left side portion 30 to the right side portion 32 with the support platform 100 generally vertically above the support cross bar 88. The first support means 112 is located intermediate the front portion 26 and the rear portion 28 of the frame 18 at a distance, h, above the floor 22. The first support means 112 is generally supported by the pair of parallel rails 40,42. In the embodiment illustrated, the first support means 112 includes a pair of generally L-shaped sockets or structures 114,116 which recieve and firmly hold the end portions 90 and 92 of the support cross bar 88.

The frame 18 is generally so constructed whereby $H+L$ can be made substantially equal to $h+l+d/2$ when the yoke 48 and support structure 86 are positioned as in FIG. 2. This allows the transmission case 12 to be positioned generally horizontally.

In accordance with the embodiment of the invention illustrated, second support means 118 are provided for supporting the support cross bar 88 from the left side portion 30 to the right side portion 32 of the frame 18 with the support platform 100 generally vertically above the support cross bar 88 and with the support structure 86 adjacent the rear portion 28 of the frame 18. FIG. 4 shows the second support means 118.

In the particular embodiment illustrated, the second support means 118 includes a pair of L-shaped sockets or structures 120,122 attached to the pair of parallel rails 40,42. In this manner, the narrower end portion 16 of the transmission case 12 can be supported a significant distance below the position of support of the wider end portion 14 as illustrated in FIG. 1. Additional adjustment is available using the telescoping support structure 94. As will be noted in FIG. 1 the yoke 48 can be pivoted at the L-shaped rods 70,72 to accommodate the positioning of the transmission case 12 as illustrated in FIG. 1.

In some instances it is desirable to support the transmission case 12 vertically with its wider end portion 14 facing upwardly. In the embodiment illustrated, this capability is provided by supporting means 124 which serve for supporting the respective end portions 60,62 of the pair of side bars 56,58 of the yoke 48 in substantially horizontal relation to the yoke crossbar 50.

The particular supporting means 124 illustrated comprises a pair of generally coaxial holes 126 (FIG. 1) and 128 (FIG. 2), one in the left side portion 30 and the other in the right side portion 32 of the frame 18 along with corresponding coaxial holes 130,132 (FIG. 2) of the pair of tubular members 64,66 of the pair of side bars 56,58, and more particularly with the coaxial holes 130,132, being at the respective end portions 60,62 of the side bars 56,58. The supporting means 124, as illustrated, further includes a pair of L-shaped rods 134,136, one for fitting in the left side portion hole 126 and in a respective one of the corresponding holes 130 of the end portions 60,62 and another for fitting in the right side portion hole 128 and in a respective other 132 of the corresponding holes 130,132 in a respective other 60 of the end portion 60,62.

A central portion 137 of the frame 18 is generally kept open so that the transmission case 12 can be readily manipulated to a desired position. Furthermore, the rear portion 28 of the frame generally does not have any cross members between the left side 30 and the right side 32 so as to allow the narrower end portion 16 of the transmission case 12 to be positioned as is desirable, particularly downwardly when the transmission case 12 is positioned generally vertically. An appropriate crossbar 138 is provided for rigidity and strength adjacent the front portion 26 of the frame 18. Generally, in order to provide a strong yet light stand 10 the frame 18 is made of tubular structural steel members.

INDUSTRIAL APPLICABILITY

The stand 10 of the present invention is particularly useful for selectively positioning a transmission case 12 in any of a number of desired positions so that a mechanic can efficiently work on a transmission held within the transmission case 12 or can work on the transmission case 12 itself should that need repair. Generally, the stand 10 is positioned to hold the transmission case 12 of an automobile but variations in size are contemplated for holding larger and smaller transmission cases and other mechanical structures which need to be readily accessible and tiltable for repair and maintenance services.

While the invention has been described in connection with specific embodiments thereof, it will be understood that it is capable of further modifications, uses or adaptations following, in general, the principles of the invention and including such departures from the present disclosure as come within known or customary practice in the art to which the invention pertains and as may be applied to the essential features hereinbefore set forth.

I claim:

1. A stand (10) for selectively positioning a case (12) which has a wider end portion (14) having generally a width, d, and a narrower end portion (16) having generally a width, d, comprising:

a rigid frame (18) having a bottom portion (20) adapted to sit on a floor (22), a top portion (24), a front portion (26), a rear portion (28), a left side portion (30) and a right side portion (32);

a yoke (48) having a yoke crossbar (50) having opposite ends (52,54) and a pair of side bar structures (56,58) each extending generally in a first direction from a respective one of said opposite ends (52,54) to respective end portions (60,62) a distance, L, which is greater than or substantially equal to D/2, from said yoke crossbar (50);

yoke supporting means (68) for supporting said yoke crossbar (50) from said left side portion (30) to said right side portion (32) adjacent said front portion (26) of said frame (18) and a distance, H, above said floor (22);

means (80) for releasably attaching said wider end portion (14) of said case (12) between said remote end portion (60,62) of said side bar structures (56,58) of said yoke (48);

a support structure (86) having a support crossbar (88) having opposite end portions (90,92) and a support bar structure (94) having a first end (96) attached to said support crossbar (88) intermediate said opposite end portions (90,92) and a second end (98) having a support platform (100) a distance, l, from said support crossbar (88), said support platform (100) being adapted to support said narrower end (16) of said case (12);

first support means (112) for supporting said support crossbar (88) from said left side portion (30) to said right side portion (32) with said support platform (100) generally vertically above said support crossbar (88) intermediate said front portion (26) and said rear portion (28) at a distance, h, above said floor (22); and wherein said case (12) can be supported generally horizontally by said yoke (48) and said support structure (86); and supporting means (124) for supporting said respective end portions (60,62) of said pair of side bar structures (56,58) of said yoke (48) in substantially horizontal relation to said yoke crossbar (50).

2. A stand (10) as set forth in claim 1, further including:

second support means (118) for supporting said support crossbar (88) from said left side portion (30) to said right side portion (32) with said support platform (100) generally vertically above said support crossbar (88) adjacent said rear portion (28) of said frame (18).

3. A stand (10) as set forth in claim 1, wherein said supporting means (124) includes a pair of generally coaxial holes (126,128), one in said left side portion (30) and another in said right side portion (32) of said frame (18), corresponding coaxial holes (130,132) in said respective end portions (60, 62) of said pair of side bar structures (56,58) and a pair of rods (134,136), one for fitting in said left side portion hole (130) and in a respective one (126) of said corresponding holes (126,128) in a respective one (62) of said end portion (60,62) and another for fitting in said right side portion hole (128) and in a respective other (132) of said corresponding holes (130,132) in a respective other (60) of said end portions (60,62).

4. A stand (10) for selectively positioning a case (12) which has a wider end portion (14) having generally a width, D, and a narrower end portion (16) having generally a width, d, comprising:

a rigid frame (18) having a bottom portion (20) adapted to sit on a floor (22), a top portion (24), a front portion (26), a rear portion (28), a left side portion (30) and a right side portion (32);

a yoke (48) having a yoke crossbar (50) having opposite ends (52,54) and a pair of side bar structures (56,58) each extending generally in a first direction from a respective one of said opposite ends (52,54) to respective end portions (60,62) a distance, L, which is greater than or substantially equal to D/2, from said yoke crossbar (50);

yoke supporting means (68) for supporting said yoke crossbar (50) from said left side portion (30) to said right side portion (32) adjacent said front portion (26) of said frame (18) and a distance, H, above said floor (22);

means (80) for releasably attaching said wider end portion (14) of said case (12) between said remote end portion (60,62) of said side bar structures (56,58) of said yoke (48);

a support structure (86) having a support crossbar (88) having opposite end portions (90,92) and a support bar structure (94) having a first end (96) attached to said support crossbar (88) intermediate said opposite end portions (90,92) and a second end (98) having a support platform (100) a distance, 1, from said support crossbar (88), said support platform (100) being adapted to support said narrower end (16) of said case (12);

first support means (112) for supporting said support crossbar (88) from said left side portion (30) to said right side portion (32) with said support platform (100) generally vertically above said support crossbar (88) intermediate said front portion (26) and said rear portion (28) at a distance, h, above said floor (22); and wherein said case (12) can be supported generally horizontally by said yoke (48) and said support structure (86); and wherein said front portion (26) is at a higher elevation than said rear portion (28) and wherein said left side portion (30) and said right side portion (32) include a pair of parallel rails (40,42) extending generally upwardly from said rear portion (28) towards said front portion (26).

5. A stand (10) as set forth in claim 4, wherein said first support means (112) and said second support means (118) are supported by said rails (40,42).

6. A stand (10) as set forth in claim 1, wherein said rear portion (28) is lacking in crossmembers from said left side portion (30) to said right side portion (32).

* * * * *

UNITED STATES PATENT AND TRADEMARK OFFICE

CERTIFICATE OF CORRECTION

PATENT NO. : 4,560,151

DATED : December 24, 1985

INVENTOR(S) : LESLIE R. GRUNDY

It is certified that error appears in the above-identified patent and that said Letters Patent is hereby corrected as shown below:

Column 5, line 56, "width, d," should be --width, D,--.

Signed and Sealed this

*Twenty-fourth* Day of *June 1986*

[SEAL]

*Attest:*

DONALD J. QUIGG

*Attesting Officer*

*Commissioner of Patents and Trademarks*